United States Patent [19]

Barbieri et al.

[11] Patent Number: 4,505,596

[45] Date of Patent: Mar. 19, 1985

[54] COMPOSABLE WALL-CLOCK

[76] Inventors: Raul Barbieri; Giorgio Marianelli, both of Via Faruffini 13, 20149 Milan, Italy

[21] Appl. No.: 575,029

[22] Filed: Jan. 30, 1984

[30] Foreign Application Priority Data

Feb. 11, 1983 [IT] Italy ..... 20781/83[U]

[51] Int. Cl.[3] ..... G04B 19/06

[52] U.S. Cl. ..... 368/236; 368/276; 368/80; 368/314; 368/294

[58] Field of Search ..... 368/80, 223, 228, 230, 368/232, 236, 276, 285, 294, 296, 314, 309

[56] References Cited

U.S. PATENT DOCUMENTS 3,283,496 11/1966 Hohenthawer ..... 368/236

FOREIGN PATENT DOCUMENTS 2352021 4/1975 Fed. Rep. of Germany ..... 368/232

329446 4/1958 Switzerland ..... 368/232

*Primary Examiner*—Bernard Roskoski

[57] ABSTRACT

The clock comprises a usual clockwork, as well as a first annular component provided with a ring of pin-like projections parallel to one another; a second component which is also annular and can be coupled with the first component and provided with a ring of openings which can be aligned with and passed through by the pin-like projections and located on an inner flange thereof; a substantially flat dial to rest on the inner flange and provided with a ring of openings which can be aligned with those of the second component and passed through the pin-like projections thus forming the time references; and a third transparent component provided with contour side insertable in the second component.

7 Claims, 2 Drawing Figures

COMPOSABLE WALL-CLOCK

This invention relates to a wall-clock, made with molded parts of plastics material, and provided with dial, hands and clockwork for the actuation of the latter.

Generally, wall-clocks require for the assembling thereof the use of screws or the like, which unavoidably adds to the production costs.

It is the main object of the present invention to provide a wall-clock of the above mentioned type, which requires for assembling thereof a highly reduced number of screw means, practically limited to the connection of the clockwork to the dial and of the hands to the actuation outlets of such a clockwork, the assembling taking place by mutual coupling of the component parts in easy and comfortable manner without any need of using particular tools.

According to the invention, a clock is essentially characterized by comprising, in addition to a usual clockwork with respective hands and dial, a first annular component provided with a ring of pin-like parallel projections, a second annular component which can be coupled with the first component and is provided with a ring of openings that can be aligned with and passed through by said pinlike projections and located on an inner flange of an undercut thereof, a substantially flat dial for rest on said flange and provided with a ring of openings that can be aligned with and passed through by said pinlike projections, so that the latter will form the time references, and a third transparent provided with contour side insertable in said cutout of the second component.

Both said three components and the dial are of plastics material and made by molding through usual molding techniques.

The invention will be more clearly understood from the following detailed description, given by mere way of illustration and in connection with the accompanying drawing, in which:

Figure 1:
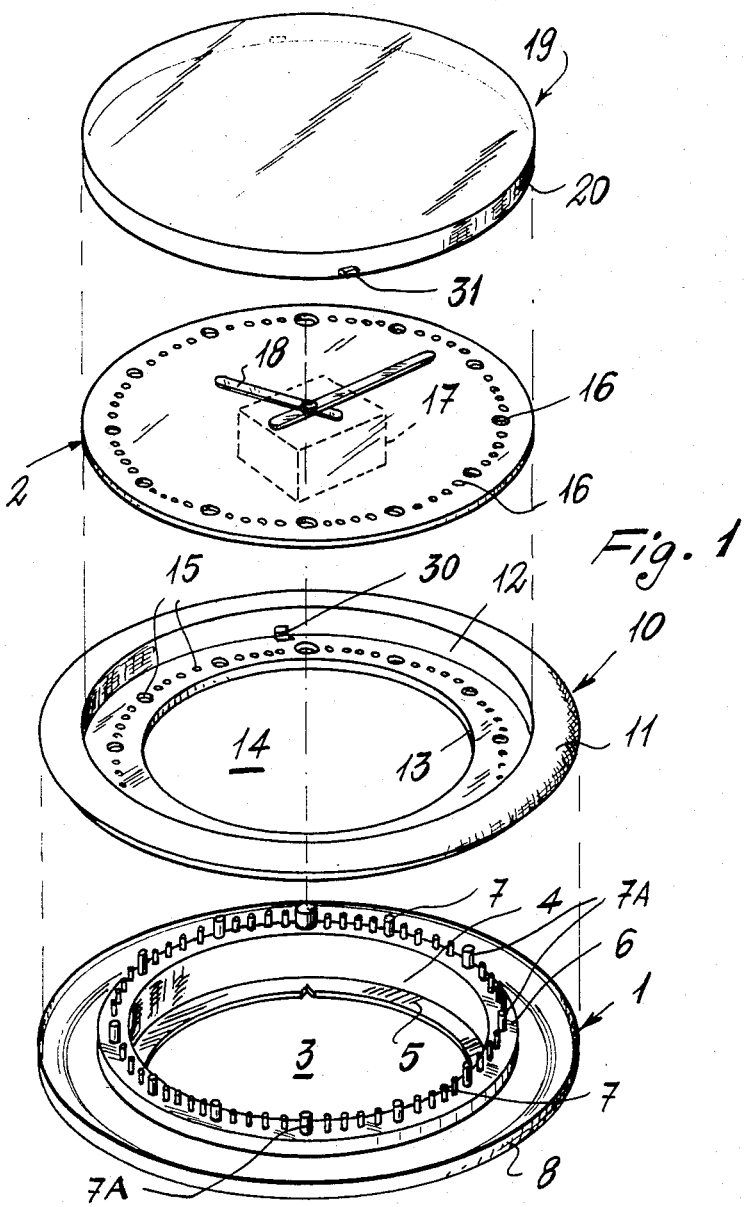
FIG. 1 is an exploded perspective view showing the clock according to the invention.

Referring to the figures of the accompanying drawing, reference numeral 1 designates the first component of the clock. This first component, molded of plastics material, intended to form part of the contour frame for the dial 2 and act as a spacer respect to the wall to which the clock is applied, is of annular shape and accordingly comprises a central circular hole 3 defined by a cylindrical wall 4 at the bottom provided with a flange 5, the latter facing the center of said hole. This wall 4 is followed by an outwardly directed and perpendicularly located annular length or section 6, from the latter projecting a ring of preferably hollow, parallel pinlike extensions 7, 7A, forming a unitary body with the remainder of said component 1. Particularly, the extensions 7, 7A are equispaced from one another and comprise extensions of major diameter and height 7A spaced by a series of four minor extensions 7. One of the major extensions differs from the others for still a major diameter. As it will be understood in the following, said pinlike extensions 7, 7A act as time references.

In the first component 1, said length or section 6 is followed by a U-shaped annular portion externally defined by a step 9 for coupling (see FIG. 2) with a suitable contour step provided in a second component, designated as a whole at 10.

This component 10, which is also made of molded plastics material, has annular shape and a U-shaped contour portion 11 defined on the inner side by a cylindrical wall 12 perpendicularly located with respect to an inner flange 13, which defines a central hole 14 and is provided with a ring or crown of holes 15 corresponding in number and diameter with the pin-like extensions 7, 7A which, after coupling of the components 1, 11, pass through the same as well as through a corresponding ring or crown of holes 16 provided in said substantially flat dial 2, which is also molded of plastics material, and to which by known screw means a known clockwork 17 with relative hands 18 is secured or attached.

The clock comprises a third component 19, molded of transparent plastics material, acting as a "glass", having a cylindrical contour side 20 and which is inserted with such a side thereof in the cavity of component 10 which is laterally defined by the side 12 of the latter.

On its contour or periphery said side 20 has two notches 31 at two diametrically opposite locations. Owing to the elasticity of the material of said component 20, these notches are intended for snap engagement in openings or seats 30 provided in the side 12 of component 10, whereby said dial 2 is held in place (between the side 20 and flange 13).

The coupling between the clock parts is carried out as follows.

Figure 2:
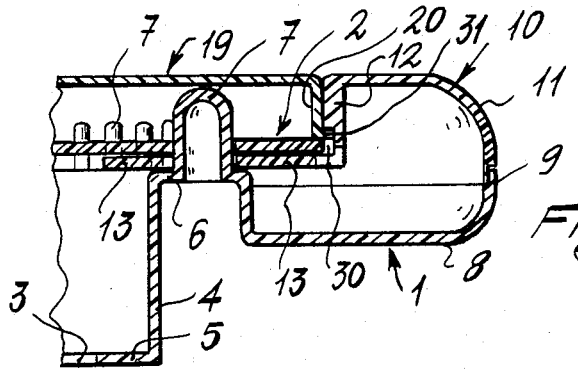
FIG. 2 is a fragmentary sectional view taken along a diametral plane of the clock.

Stating before hand that the pin-like extensions 7, 7A are dimensioned to enter the holes 15, 16 by slight driving force, the components 1 and 11 are superimposed so that the pin-like projections 7, 7A of the first component would enter the corresponding holes 15 of the other component, and so that the outer contours or peripheries thereof interengage (owing to the steps, such as 9 in FIG. 2). Then the dial 2 is inserted in the component 11, so that the pin-like projections 7, 7A enter the corresponding holes 16 of the dial, and then the component 19 (that is the glass) is superimposed by inserting the cylindrical side 20 thereof in the cavity of the component 10 laterally defined by the wall 12, until the snap coupling of the notches 31 in the seats 30 is obtained.

What we claim is:

1. A wall-clock comprising a dial, hands and a clockwork for the actuation of the latter, wherein the clock includes a first annular component provided with a ring or crown of pin-like parallel projections; a second annular component which can be coupled with the first component and is provided with a ring or crown of openings that can be aligned with and passed through by said projections and located on an inner flange, a substantially flat dial for rest on said flange and provided with a ring or crown of openings that can be aligned with and passed through by said pin-like projections, so that the latter form the time references, and a third transparent component provided with contour side insertable in the second component.

2. A clock as claimed in claim 1, wherein the pin-like projections are of different dimensions and preferably with major projections spaced apart by four minor projections.

3. A clock as claimed in claim 2, wherein at least one pin-like projection is of a larger size than all the other projections.

4. A clock as claimed in claim 1, wherein said three sides and dial are molded of plastics material.

5. A clock as claimed in claim 1, wherein for the coupling of the third component with the second component, the latter is provided with openings snap engaged by notches provided at the bottom of said third component.

6. A clock as claimed in claim 1, wherein said first and second component are interengaged by means provided at the periphery thereof.

7. A clock as claimed in claim 1, wherein said pin-like projections are dimensioned to enter said openings by slight driving force.

* * * * *